US008147362B2

(12) United States Patent
Muntanion et al.

(10) Patent No.: US 8,147,362 B2
(45) Date of Patent: Apr. 3, 2012

(54) ARROWHEAD HAVING BLADES OFFSET REARWARD FROM THE TIP

(75) Inventors: Karl Muntanion, Schaumburg, IL (US); Christopher A. Kozlik, Schaumburg, IL (US)

(73) Assignee: New Archery Products Corp., Forest Park, IL (US)

( * ) Notice: Subject to any disclaimer, the term of this patent is extended or adjusted under 35 U.S.C. 154(b) by 212 days.

(21) Appl. No.: 12/455,455

(22) Filed: Jun. 2, 2009

(65) Prior Publication Data

US 2010/0304904 A1 Dec. 2, 2010

(51) Int. Cl.
*F42B 6/08* (2006.01)

(52) U.S. Cl. ..... 473/584; 473/583

(58) Field of Classification Search ..... 473/582, 473/583, 584

See application file for complete search history.

(56) References Cited

U.S. PATENT DOCUMENTS

| | | | | |
|---|---|---|---|---|
| 2,568,417 | A * | 9/1951 | Steinbacher | 473/583 |
| 4,006,901 | A | 2/1977 | Simo | |
| 4,093,230 | A | 6/1978 | Simo | |
| 4,175,749 | A | 11/1979 | Simo | |
| 4,203,601 | A | 5/1980 | Simo | |
| 4,380,340 | A | 4/1983 | Simo | |
| 4,381,866 | A | 5/1983 | Simo | |
| 4,529,208 | A | 7/1985 | Simo | |
| 4,676,512 | A | 6/1987 | Simo | |
| 5,078,407 | A * | 1/1992 | Carlston et al. | 473/583 |
| 5,143,380 | A * | 9/1992 | Maleski | 473/584 |
| 5,564,713 | A | 10/1996 | Mizek et al. | |
| 5,871,410 | A | 2/1999 | Simo et al. | |
| 6,398,676 | B1 | 6/2002 | Mizek | |
| 7,025,697 | B2 | 4/2006 | Mizek et al. | |
| 7,037,222 | B2 | 5/2006 | Mizek et al. | |
| 7,232,390 | B2 | 6/2007 | Mizek et al. | |
| 7,338,397 | B2 | 3/2008 | Mizek et al. | |
| 2006/0084535 | A1 * | 4/2006 | Kuhn | 473/583 |
| 2009/0203477 | A1 | 8/2009 | Mizek et al. | |
| 2010/0299942 | A1 | 12/2010 | Simo et al. | |

* cited by examiner

*Primary Examiner* — John Ricci

(74) *Attorney, Agent, or Firm* — Pauley Petersen & Erickson

(57) ABSTRACT

An archery arrowhead having a tip and a body with blade slots that each accept a blade. Each blade having a leading edge and an opposite trailing edge. The leading edge formed by a first cutting surface and a second cutting surface that diverge from each other in a rearward direction from the leading edge to the trailing edge. The first cutting surface and the second cutting surface forming a point, the point offset from a rearward edge of the tip.

17 Claims, 5 Drawing Sheets

ARROWHEAD HAVING BLADES OFFSET REARWARD FROM THE TIP

BACKGROUND OF THE INVENTION

1. Field of the Invention

This invention relates to an arrowhead having a tip and one or more blades positioned rearward of the tip.

2. Discussion of Related Art

Some conventional arrowheads have blades which extend from a tip of the arrow head. In such design, forces generated by launching the arrow are immediately transferred from the tip to the blades upon impact with a target. Often the target is an animal with a very tough hide. By immediately transferring the forces from the tip to the blade upon impact the depth of penetration can be limited.

Other conventional arrowheads have tips without blades and transfer forces generated by launching the arrow to a relatively small area of the tip, more easily penetrating a tough hide of the animal. However, these arrowheads often create a minimal wound channel that fails to bring down a hit and wounded animal, often resulting in the animal escaping and a hunter losing the prey.

There is a continuing need for an improved arrowhead that provides a small initial impact area and a maximum wound channel. Also, there is an apparent need for an arrowhead that can be easily manufactured and conveniently assembled and disassembled, particularly in the field, for example to simplify parts replacement procedures.

SUMMARY OF THE INVENTION

The arrowhead of this invention includes a blade carrying body, a tip portion and at least one blade. In some embodiments, a rear section of the tip portion is positioned in front of one or more of the blades, by an offset distance. The blades can be arranged in either a radial or non-radial orientation with respect to a central longitudinal axis of the blade carrying body.

The offset blades include two cutting surfaces. The two cutting surfaces intersect at a leading edge of the blade and can form a point. From this point, the two cutting surfaces diverge from one another in a rearward direction from the leading end of the blade toward a trailing end of the blade.

The tip portion can be integrated with or separately formed and connected to the blade carrying body. The tip portion can be formed of any shape known to those skilled in the art, including but not limited to a conical shape, a pyramid shape and a bulged pyramid shape. The blades can be connected to the blade carrying body so that the point of the blade is offset rearward from the tip portion by a selected distance. Preferably, the point of the blade is positioned behind the rear end of the tip portion, with a vertical spacing between the point of the blade and both a rearward portion of the tip portion and the blade carrying body.

By offsetting the leading edge of the blades from the tip, according to this invention, the force of the launched arrow can be transmitted solely to and through the tip at initial impact; thus allowing the arrowhead to penetrate the tough hides of many animals. After tip penetration, the blades can then penetrate and create a wound channel that will quickly subdue a hit animal.

BRIEF DESCRIPTION OF THE DRAWINGS

These and other objects and features of this invention will be better understood from the following detailed description taken in conjunction with the drawings, wherein.

DESCRIPTION OF PREFERRED EMBODIMENTS

Figure 1:
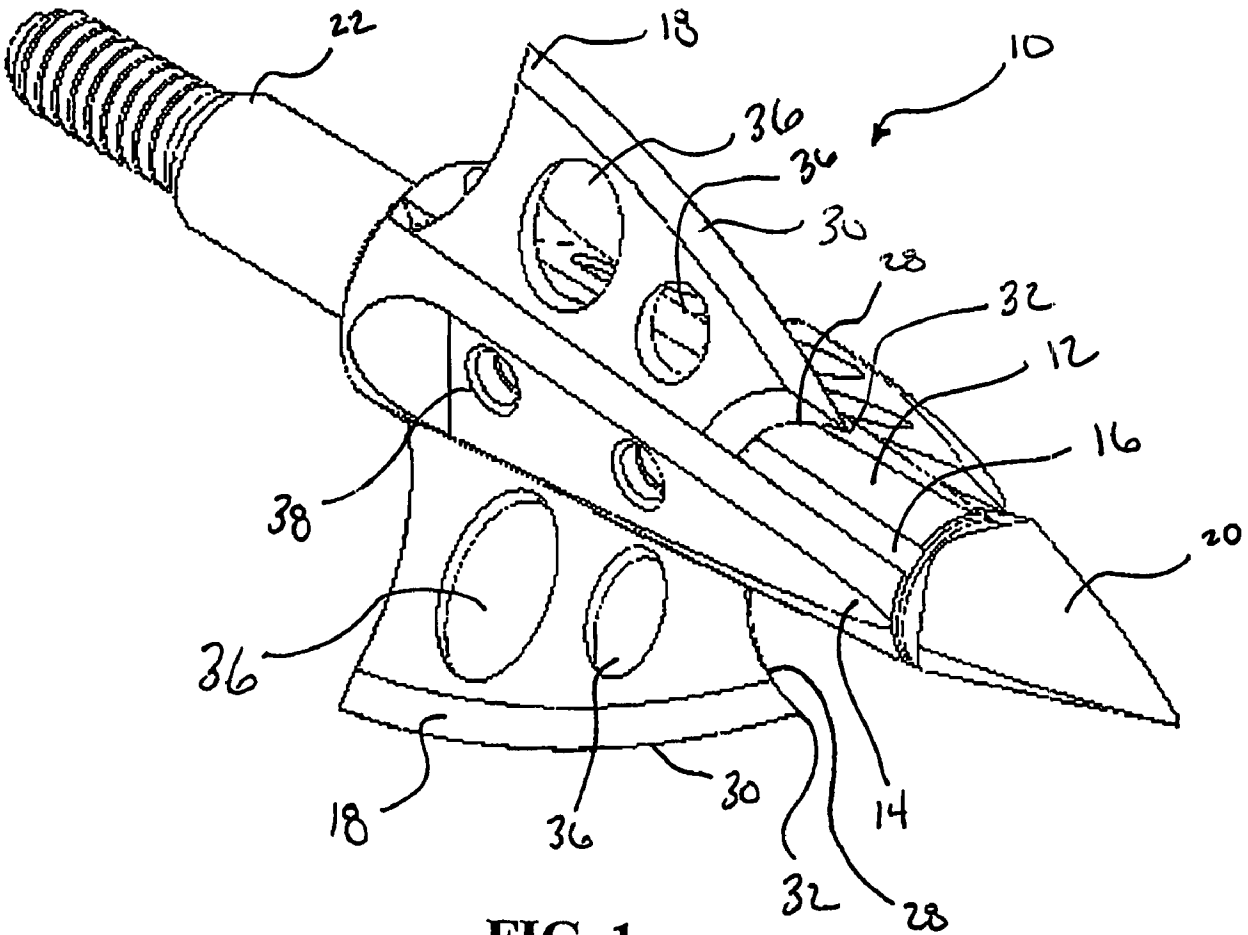
FIG. 1 is a perspective view of an arrowhead according to one embodiment of this invention.
Figure 2:
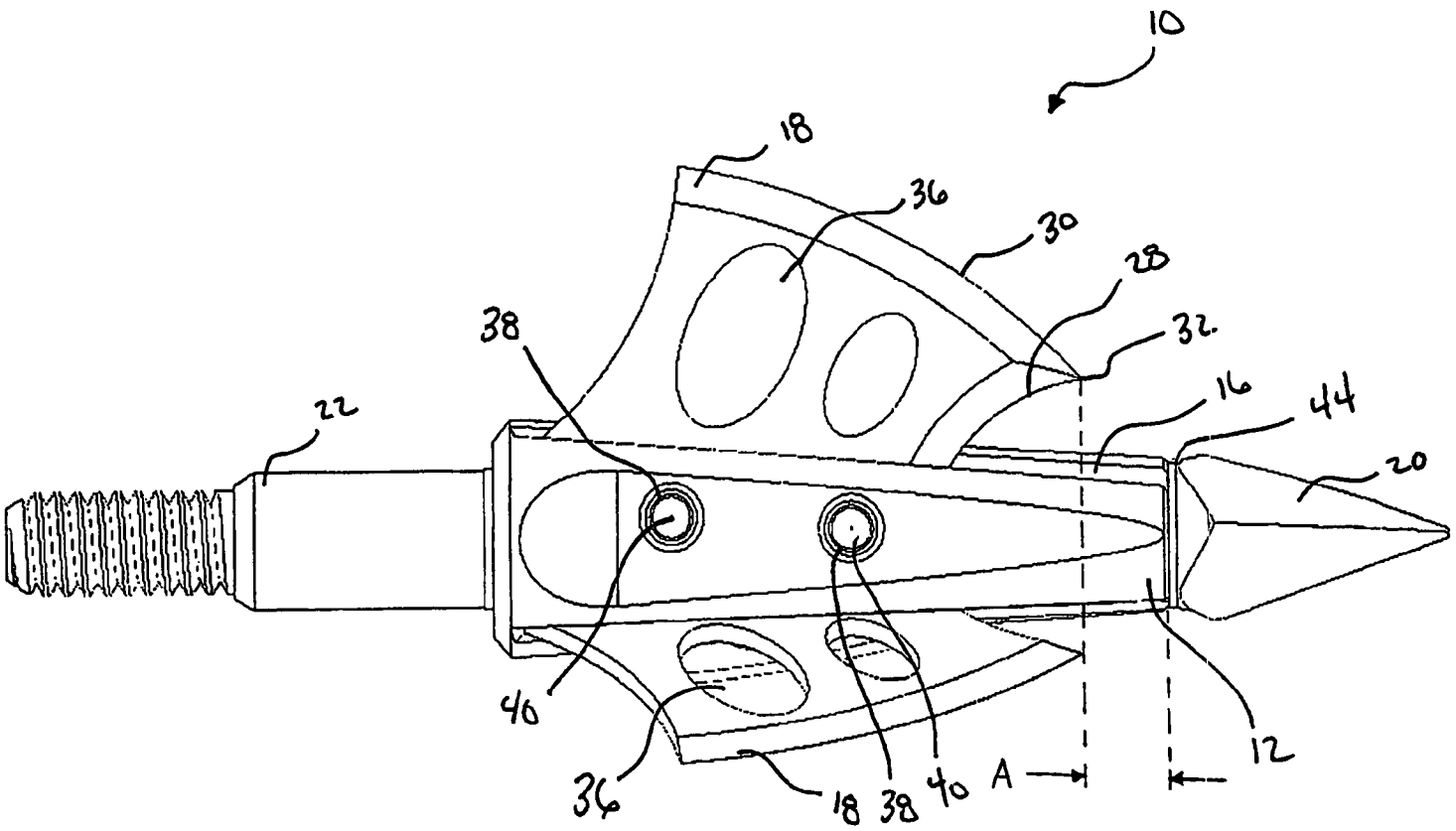
FIG. 2 is a side view of the arrowhead of FIG. 1.
Figure 3:
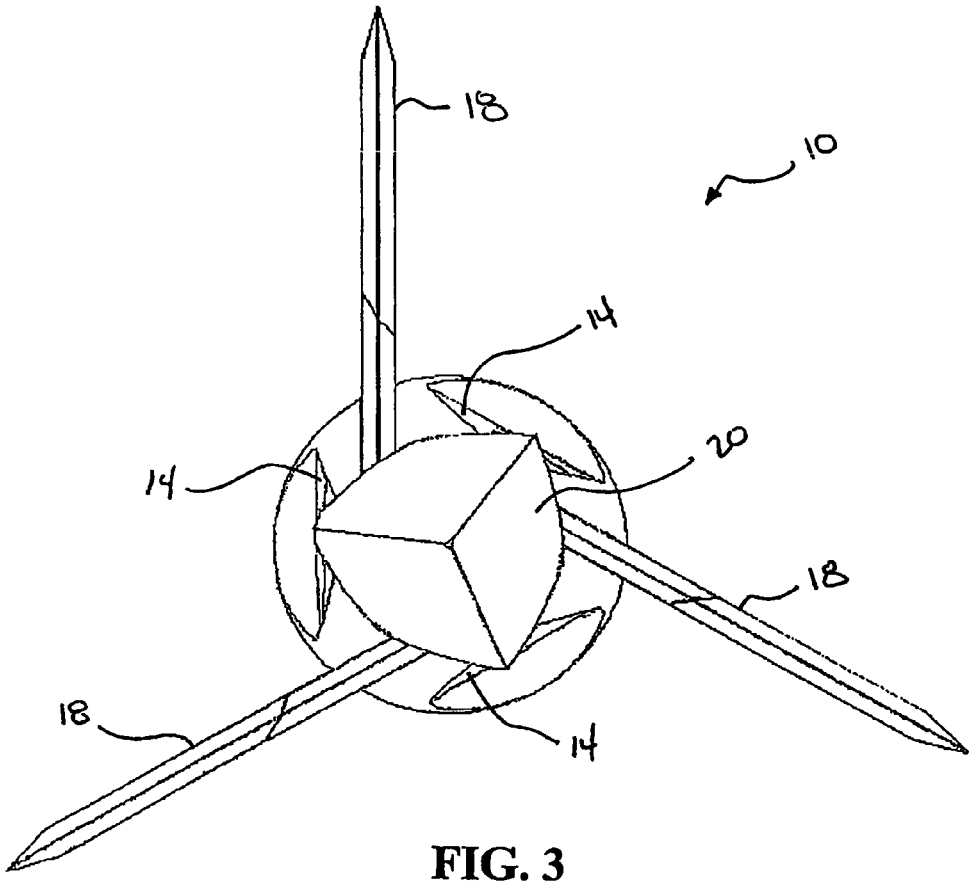
FIG. 3 is a front view of the arrowhead of FIG. 1.

FIGS. 1-3 show different views of arrowhead 10, according to one embodiment of this invention. Arrowhead 10 comprises blade carrying body 12. In this embodiment, blade carrying body 12 has a generally circular cross section but with three flattened surfaces 14. Alternatively, body 12 can have any other suitable shape or configuration similar to any conventional arrowhead or to any shape that provides acceptable aerodynamic flight characteristics.

Arrowhead 10 comprises tip portion 20 connected to and/or integrated with blade carrying body 12. Tip portion 20 can be connected to and/or integrated with blade carrying body 12 by various and alternative methods. For example, tip portion 20 can be integrally formed as one piece with blade carrying body 12. Tip portion 20 can also be a separately formed part that is connected or attached to body 12 in any suitable manner, including but not limited to a threaded connection, a friction fit, and/or with an adhesive. In the embodiment shown in FIGS. 1-3, tip portion 20 has a pyramid shape with three bulged sides. Various sizes, shapes and/or configurations, such as a conical shape or a pyramid shape, are also available for tip portion 20.

Arrowhead 10 comprises connector 22 at an opposite end from tip portion 20 for connecting arrowhead 10 to a conventional arrow shaft. Connector 22 is shown in FIGS. 1 and 2 as comprising a threaded shaft portion for screwing into corresponding threads within an arrow shaft. Various other structures and/or methods for joining connector 22 to an arrow shaft can be used, including, without limitation, a friction fit and/or an adhesive connection.

Figure 5:
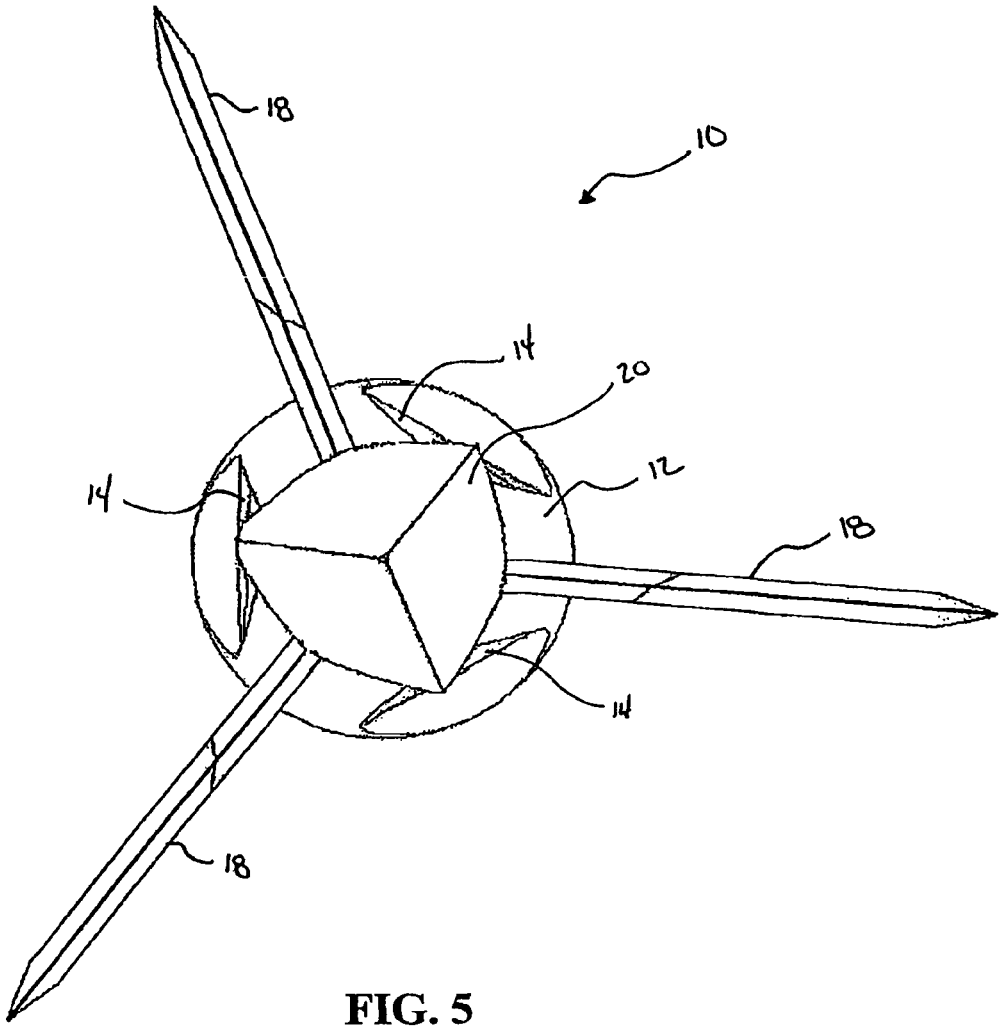
FIG. 5 is a front view of an arrowhead according to another embodiment of this invention.

As shown in FIGS. 1, 3 and 5, arrowhead 10 comprises three blades 18. Each blade 18 includes leading end 24 and opposite trailing end 26. As used throughout this specification and in the claims, the terms leading and trailing relate to a forward or front and a rearward or rear of arrowhead 10, respectively, relative to a normal direction of flight of an arrow with which arrowhead 10 is attached or connected in a conventional manner. Each blade 18 has first cutting surface 28 and second cutting surface 30. First cutting surface 28 and second cutting surface 30 intersect with each other at leading end 24 to form point 32 and diverge from each other in a rearward direction from leading end 24 to trailing end 26. In one embodiment, as shown in FIGS. 1 and 2, point 32 is spaced at a distance from blade carrying body 12, and point 32 is positioned above or over blade carrying body 12. In some embodiments of this invention, no portion of blade 18 is between point 32 and body 12. In this configuration, point 32 is the leading portion of blade 18.

In the embodiment of the invention shown in FIGS. 1-3, both first cutting surface 28 and second cutting surface 30 have non-linear shapes. As shown, first cutting surface 28 forms or follows an inward curving arc and second cutting surface 30 forms or follows an outward curving arc. In other embodiments, first cutting surface 28 may have any other suitable shape including but not limited to a linear shape or an outward arcuate shape. Second cutting surface 30 can have any other suitable shape, similar or independent of first cutting surface 28, including but not limited to a linear shape or an inward arcuate shape. In some embodiments, first cutting surface 28 comprises a single-bevel sharpened edge and second cutting surface 30 comprises a double-bevel sharpened edge. Alternatively, first cutting surface 28 can comprise a double bevel edge and/or second cutting surface 30 can comprise a single-bevel sharpened edge.

Figure 4:
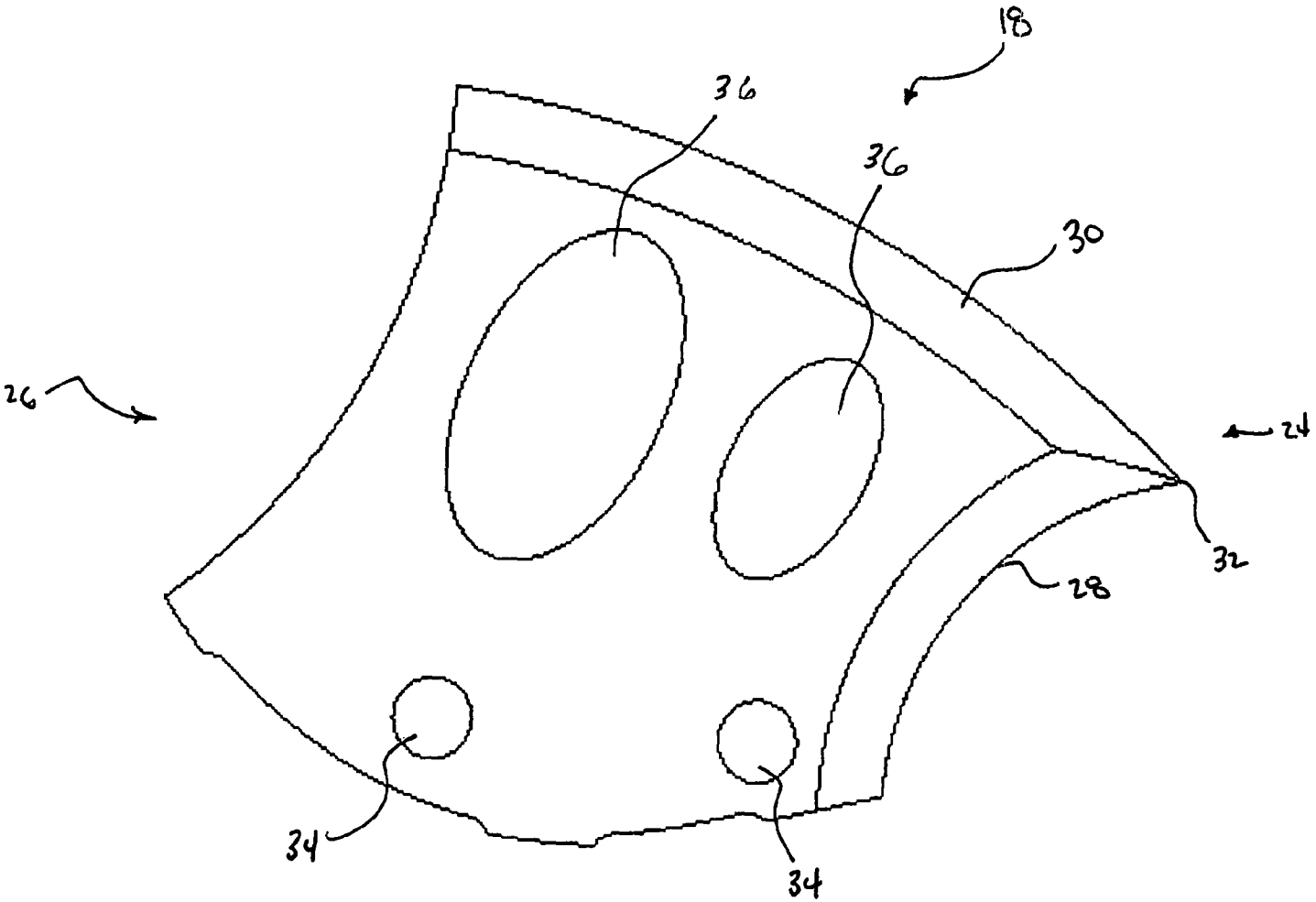
FIG. 4 is a side view of a blade according to one embodiment of this invention.

FIG. 4 shows a blade 18 removed from blade carrying body 12. As shown in FIG. 4, blade 18 includes two through bores 34 within base portion 46 of blade 18. Through bores 34 can be used for attaching blade 18 to blade carrying body 12. Blade 18 can include any number of through bores 34 and/or closed bores, depending on a particular need. In alternative embodiments, blade 18 is solid and has no through bore 34.

As shown in FIGS. 1-4, each blade 18 also includes two cut-outs 36. Each blade 18 can include any number of cut-outs 36, depending on a particular need. Each cut-out 36 can enhance the weight properties of blade 18. Cut-out 36 can also enhance the stability of arrowhead 10 and/or to impart rotation upon arrowhead 10.

Referring to FIGS. 1-3, body 12 has three slots 16 that each accept or receive base portion 46 of a corresponding blade 18. The three slots 16 are preferably but not necessarily arranged about body 12 with equal spacing between adjacent slots 16. Although arrowhead 10 is shown with three blades 18 and three slots 16, it is apparent that arrowhead 10 may comprise more or fewer blades 18 and/or slots 16.

The base portion 46 of each blade 18 shown in FIG. 4 can be inserted into a corresponding blade slot 16. In some embodiments of this invention, body 12 includes two mounting bores 38 within each flattened surface 14. Each mounting bore 38 of body 12 can be aligned with one bore 34 of the corresponding inserted blade 18. In this manner, blade 18 can be securely attached or fastened to body 12 by mounting pin 40, shown in FIG. 2, within an aligned mounting bore 38 and through bore 34 pair. Pin 40 can comprise, without limitation, a screw, a bolt and/or a rivet. In another embodiment of this invention, blade 18 does not include or has no through bore 34, and instead pin 40 frictionally contacts blade 18 against an inside wall or another contact position within slot 16 to secure blade 18 with respect to body 12. Blade 18 can also be secured in blade slot 16 in other ways including, without limitation, using a welding or an adhesive method. In another alternative, blades 18 are integrally formed as one-piece with blade carrying body 12.

As shown in FIG. 3, in some embodiments, each inserted blade 18 and each slot 16 is positioned with respect to body 12 generally within a plane tangent to an outer surface of the body 12. FIG. 5 shows a front view of arrowhead 10 according to some embodiments of this invention. As shown, each blade 18 and blade slot 16 are generally coplanar or aligned with a central longitudinal axis of body 12 and radially extend outward therefrom.

Referring to FIG. 2, point 32 of blade 18 is offset by a distance A from rearward edge 44 of tip portion 20. Positioning point 32 at distance A behind rearward edge 44 of tip portion 20 allows an impact force of a launched arrow hitting a target to be applied at tip portion 20 and then distributed to and through blades 18. Focusing the impact force at tip portion 20 and time delaying an impact of each point 32 facilitates, enhances and/or improves penetration of or piercing through a tough hide of an animal. The subsequent impact of each blade 18 forms an increased wound channel, for subduing the targeted animal.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of preferred embodiments, yet the absence of a particular advantage shall not be construed to necessarily mean that such an embodiment is outside the scope of this invention.

What is claimed is:

1. An arrowhead comprising:

a blade-carrying body having a tip portion, at least one blade mounted with respect to said body, each said blade having a leading end and an opposite trailing end, said leading end formed by a first cutting surface and a second cutting surface that diverge from each other in a rearward direction from said leading end to said trailing end, said leading end terminating at a position rearward of said tip portion, and said first cutting surface being non-linear.

2. The arrowhead according to claim 1, wherein said first cutting surface and said second cutting surface intersect with each other at said leading end.

3. The arrowhead according to claim 2, wherein said first cutting surface and said second cutting surface form a point at said leading end.

4. The arrowhead according to claim 1, wherein each said blade is at least partially positioned within a corresponding blade slot formed by said body.

5. The arrowhead according to claim 4, wherein said blade slot extends in a direction that is co-planar with a center of said body.

6. The arrowhead according to claim 1, wherein said first cutting surface is positioned closer to said body than said second cutting surface.

7. The arrowhead according to claim 1, wherein each said blade is mounted perpendicular to said body.

8. The arrowhead of claim 1, wherein the first cutting surface is a single-bevel sharpened edge and the second cutting surface is a double-bevel sharpened edge.

9. An arrowhead comprising:

a blade-carrying body having a tip portion, at least one blade mounted with respect to said body, each said blade having a leading end and an opposite trailing end, said leading end formed by a first cutting surface and a second cutting surface that diverge from each other in a rearward direction from said leading end to said trailing end, said leading end terminating at a position rearward of said tip portion, and said second cutting surface being non-linear.

10. An arrowhead comprising:

a blade-carrying body having a tip portion, at least one blade mounted with respect to said body, each said blade having a leading end and an opposite trailing end, said leading end formed by a first cutting surface and a second cutting surface that diverge from each other in a rearward direction from said leading end to said trailing end, said leading end terminating at a position rearward of said tip portion, said first cutting surface positioned closer to said body than said second cutting surface, and said first cutting surface forming an inward arc and said second cutting surface forms forming an outward arc.

11. An arrowhead comprising:

a blade-carrying body having a tip portion, at least one blade mounted with respect to said body, each said blade having a leading end and an opposite trailing end, said leading end formed by a first cutting surface and a second cutting surface that diverge from each other in a rearward direction from said leading end to said trailing end, said leading end terminating at a position rearward of said tip portion, said first cutting surface positioned closer to said body than said second cutting surface, and said first cutting surface having an inward curve with respect to said body and said second cutting surface having an outward curve with respect to said body.

12. An arrowhead comprising:

a blade-carrying body having a tip portion, at least one blade mounted with respect to said body, each said blade having a leading end and an opposite trailing end, said leading end formed by a first cutting surface and a second cutting surface that diverge from each other in a rearward direction from said leading end to said trailing end, said leading end terminating at a position rearward of said tip portion, each said blade at least partially positioned within a corresponding blade slot formed by said body, and said body having at least one mounting bore and said blade having at least one through bore, wherein a pin engages with said mounting bore and said through bore to secure said blade to said body.

13. The arrowhead according to claim 12, wherein said pin and mounting bore each comprise threads.

14. An arrowhead comprising:

a blade-carrying body having a tip portion, at least one blade mounted with respect to said body, each said blade having a leading end and an opposite trailing end, said leading end formed by a first cutting surface and a second cutting surface that diverge from each other in a rearward direction from said leading end to said trailing end, said leading end terminating at a position rearward of said tip portion, each said blade at least partially positioned within a corresponding blade slot formed by said body, and said blade slot extending in a direction that is non-planar with a center of said body.

15. An arrowhead comprising:

a blade-carrying body having a tip portion, and three offset blades mounted with respect to said body in a plane tangent to an outer surface of the body, each of said blades formed by a first cutting surface and a second cutting surface that intersect at a point disposed toward and rearward of the tip portion and that diverge from each other in a rearward direction, the first cutting surface being a single-bevel sharpened edge and the second cutting surface being a double-bevel sharpened edge.

16. The arrowhead according to claim 15, wherein said first cutting surface is non-linear.

17. The arrowhead of claim 15, wherein the point is at a leading edge of each said blade.

* * * * *